United States Patent [19]

Olmsted et al.

[11] 4,436,016

[45] Mar. 13, 1984

[54] VARIABLE ENERGY MISSILE EJECT SYSTEM

[75] Inventors: Gaylord S. Olmsted, Los Altos; Gordon W. Rosno, Saratoga, both of Calif.

[73] Assignee: Westinghouse Electric Corp., Pittsburgh, Pa.

[21] Appl. No.: 291,746

[22] Filed: Aug. 11, 1981

[51] Int. Cl.[3] ..... F41F 3/04

[52] U.S. Cl. ..... 89/1.809; 89/1.818

[58] Field of Search ..... 89/1.809, 1.810, 1.8, 89/1.818

[56] References Cited

U.S. PATENT DOCUMENTS

| | | | |
|---|---|---|---|
| 2,989,899 | 6/1961 | Siegel et al. | 89/1.81 |
| 3,088,377 | 5/1963 | Siegel | 89/1.81 |
| 3,182,554 | 5/1965 | Barakauskas | 89/1.81 |
| 3,183,904 | 5/1965 | Barakauskas | 89/1.81 |
| 3,298,278 | 1/1967 | Barakauskas | 89/1.81 X |
| 4,185,538 | 1/1980 | Barakauskas | 89/1.81 |

*Primary Examiner*—David H. Brown

*Attorney, Agent, or Firm*—F. J. Baehr, Jr.

[57] ABSTRACT

A variable energy missile eject system comprising in combination water bypass valves that can be remotely operated to increase the flow of water into a hot gas stream to reduce the energy output of the missile eject system and thereby vary the energy applied to launch the missile by selectively operating the bypass valves.

7 Claims, 6 Drawing Figures

VARIABLE ENERGY MISSILE EJECT SYSTEM

GOVERNMENT CONTRACT CLAUSE

The invention described hereinafter was made in the performance of work under a U.S. Government contract with the Department of Defense.

BACKGROUND OF THE INVENTION

This invention relates to an eject system and more particularly to a system for ejecting a missile from a submarine.

Missile launches are required to be conducted at different depths of water. With the present eject system, the energy available to do work is fixed regardless of the water depth selected for launch. Because the drag forces on the missile are not fixed but are a function of the depth of launch, the missile launch performance will vary inversely with water depth. Recent emphasis has been directed at providing additional protection to the submarine while at the same time ensuring missile loads due to the launch pulse do not increase. The dilemma that is encountered is that with a fixed energy launch system, increased submarine protection can only be obtained at the expense of missile load considerations.

SUMMARY OF THE INVENTION

In general a variable energy eject system, when made in accordance with this invention, comprises an invariable gas generator having an outlet nozzle, a cooling chamber filled with a liquid and having an outer housing, and a standpipe disposed within the housing to form a centrally located gas conduit in fluid communication with the gas generator outlet nozzle. The standpipe has a nozzle disposed in the lower portion thereof. The standpipe has an inner and outer wall portion disposed to form an inner annular chamber above the standpipe nozzle and an outer annular chamber extending above and below the standpipe nozzle. The system also comprises a first set of ports in the standpipe disposed above the standpipe nozzle to provide fluid communication between the gas conduit and the inner annular chamber, a second set of ports in the standpipe disposed in an upper portion of the outer wall of the standpipe providing fluid communication between the inner annular chamber and the outer annular chamber, a third set of ports disposed in the standpipe below the standpipe nozzle providing fluid communication between the gas conduit and the outer annular chamber and a fourth set of ports disposed to provide fluid communication between the gas conduit and the second annular chamber. The system also comprises a valve for controlling the flow of fluid through the fourth set of ports and a rupture disc disposed in the gas conduit to seal the fluid in the annular chambers and gas conduit.

BRIEF DESCRIPTION OF THE DRAWINGS

The objects and advantages of this invention will become more apparent from reading the following detailed description in conjunction with the accompanying drawings in which.

DESCRIPTION OF THE PREFERRED EMBODIMENT

Figure 1:
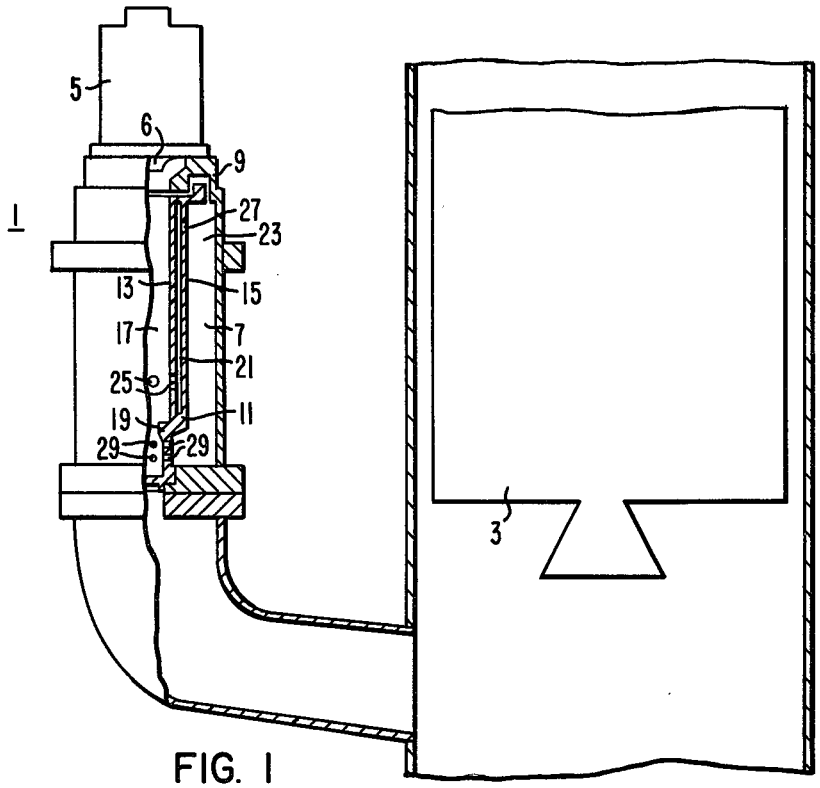
FIG. 1 PRIOR ART
FIG. 1 is a partial sectional view of prior art fixed energy missile eject systems.
Figure 3:
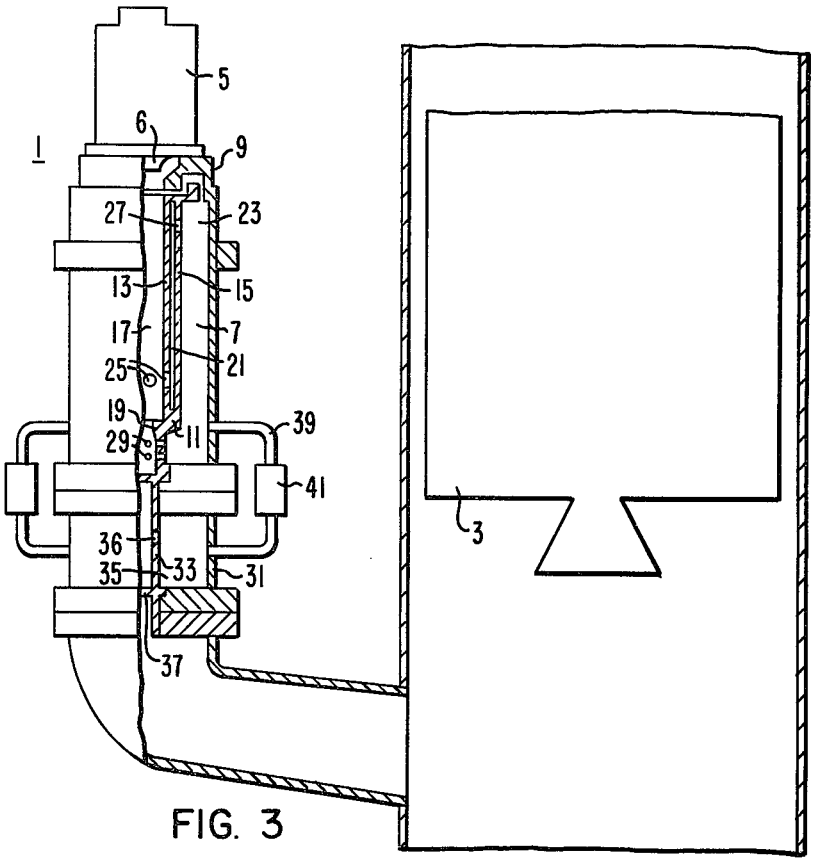
FIG. 3 is a partial sectional view of a variable energy missile eject system made in accordance with this invention.

Referring now to the drawings in detail and in particular to FIG. 3 there is shown a variable energy missile eject system 1 for launching a missile 3 from a submarine (not shown). A prior art mixed energy missile ejection system is shown in FIG. 1 and corresponding reference numerals will where applicable be utilized in both figures.

The variable missile eject system 1 comprises a fixed or invariable energy gas generator or solid fuel rocket motor 5, having an outlet nozzle 6 at one end thereof, a cooling chamber 7 disposed in a housing 9 and filled with a liquid such as water. Disposed within the housing 9 is a standpipe 11 having an inner and outer wall portion 13 and 15, respectively. The standpipe 11 forms a gas conduit 17 in fluid communication with the outlet nozzle 6 of the gas generator 5. A nozzle 19 is disposed in the lower portion of the gas conduit 17. An inner annular chamber 21 is disposed between the inner and outer walls 13 and 15 of the standpipe 11 and an outer annular chamber 23 is disposed between the outer 15 and the housing 9. Disposed in the inner wall 13 above the nozzle 19 are a first set of ports 25 providing fluid communication between the gas conduit 17 and the inner annular chamber 21. Disposed in the outer wall 15 adjacent the upper end of the standpipe 11 are a second set of ports 27 providing fluid communication between the inner annular chamber 21 and the outer annular chamber 23. Also disposed in the inner wall of standpipe 11 below the nozzle 19 is a third set of ports 29 providing fluid communication between the outer annular chamber 23 and the gas conduit 17.

A spool piece 31 is disposed below the housing 9. Centrally located within the spool piece 31 is a sleeve 33 forming an extension of the gas conduit 17 and also forming an annular chamber 35 between the sleeve 33 and the spool piece 31. A fourth set of ports 36 are disposed in the sleeve 33 providing fluid communication between the opening within the sleeve 33 and the annular chamber 35.

A rupture disc 37 is disposed at the lower end of the gas conduit 17 to seal liquid within the housing. The rupture disc 37 will rupture when the gas generator is fired.

Conduits 39 provide fluid communication between the outer annular chamber 23 and the annular chamber 35 in the spool piece 31. Valves 41 or other fluid control means, for example, a rupture disc, control the flow of fluid from the annular chamber 23 to the annular chamber 35 and eventually to the fourth set of ports 36.

Figure 2:
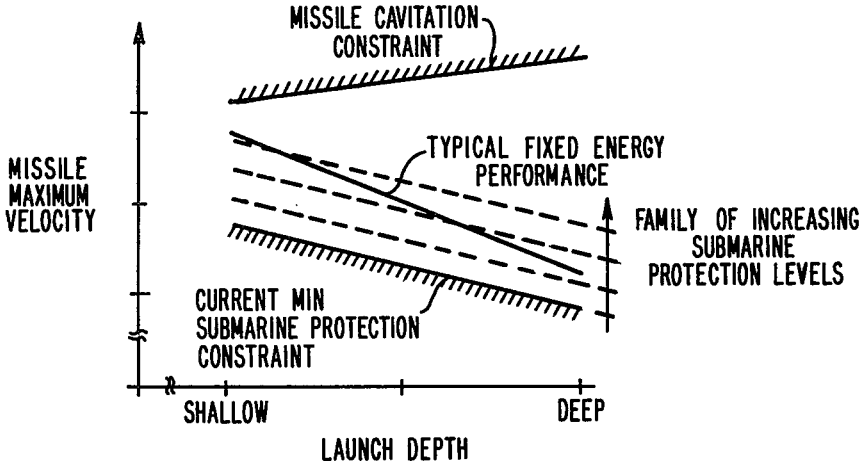
FIG. 2 is a velocity versus depth curve for the fixed energy missile eject system of the prior art.
Figure 4:
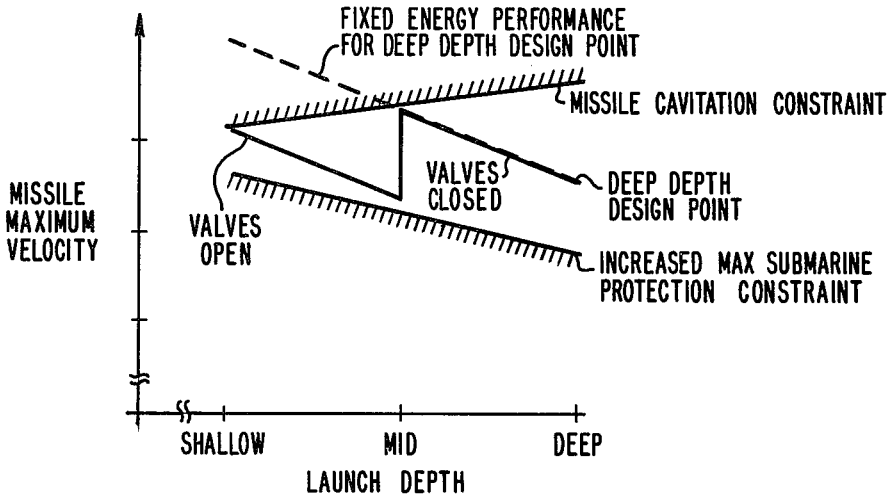
FIG. 4 is a velocity versus depth curve for the variable energy missile eject system.
Figure 6:
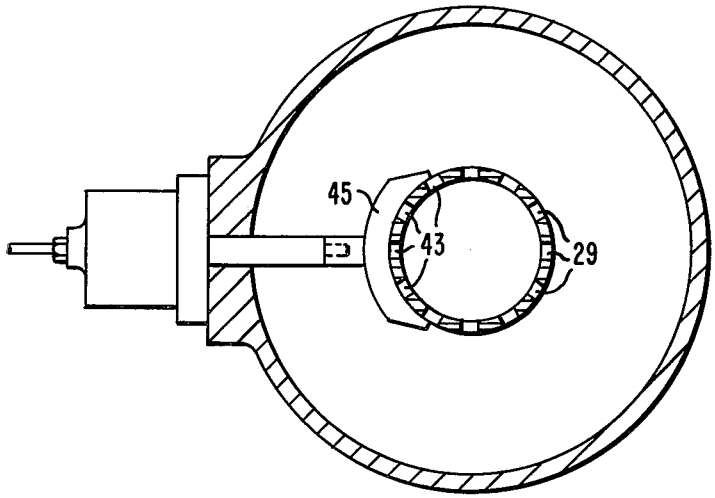
FIG. 6 is a partial sectional view taken on line VI—VI of FIG. 5.

The operation of the variable energy missile eject system is such that when the valves 41 remain closed when the gas generator is ignited. The rupture disc ruptures and shock waves and a slug of water are rapidly advanced through the gas conduits. The shock waves cause the pressure in the inner annular chamber to increase rapidly forcing the water in the outer annular chamber to spray through the third set of ports mixing it rapidly with the gas being produced by the gas generator and reducing the temperature of the mixture. The system continues to operate in this manner producing a given amount of energy at suitable pressures and temperatures to eject the missile from the launch tube. When the valves 41 are open additional high pressure water is injected into the gas stream as the water mixes therewith it reduces the energy in the hot gases by an endothermic thermodynamic conversion of water into steam. The prior art missile eject system as shown in FIG. 2 only produces a single quantity of energy; however as shown in FIG. 4 the variable energy missile eject system produces generally two levels of energy allowing increased submarine protection without contravening the loading restraints on the missile.

Figure 5:
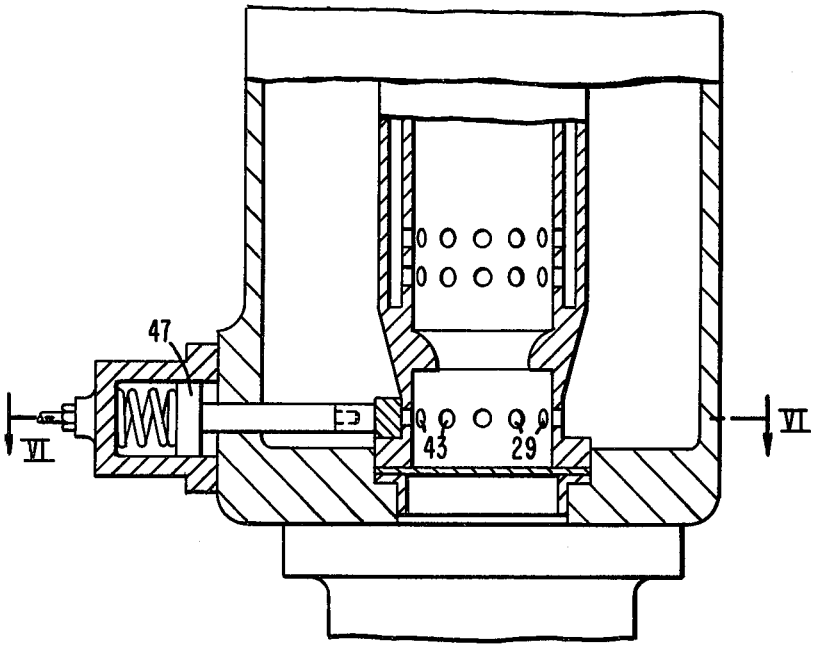
FIG. 5 is a partial sectional view of an alternative embodiment.

FIG. 5 shows a variable energy missile eject system wherein the fourth set of ports 43 are disposed in the standpipe 11 to provide fluid communication between the gas conduit 17 and the outer annular chamber 23. An arcuate member 45 fits over the ports 43 and a piston 47 or other actuating means controls the flow of fluid through the fourth set of ports 43 to vary the energy supplied to launch the missile. The various embodiments are physically different however their operation is similar.

We claim:

1. A variable energy missile eject system comprising an invariable gas generator having an outlet nozzle;

a cooling chamber filled with a liquid and having an outer housing;

a standpipe disposed within said housing to form a centrally located gas conduit in fluid communication with said gas generator outlet nozzle;

said standpipe having a nozzle disposed in the lower portion;

said standpipe having an inner and outer wall portion disposed to form an inner annular chamber above said standpipe nozzle and an outer annular chamber extending above and below said standpipe nozzle;

a first set of ports in said standpipe disposed above said standpipe nozzle providing fluid communication between said gas conduit and said inner annular chamber;

a second set of ports in said standpipe disposed in the upper portion of said outer wall of said standpipe providing fluid communication between inner annular chamber and said outer annular chamber;

a third set of ports disposed in said standpipe below said standpipe nozzle providing fluid communication between said gas conduit and said outer annular chamber;

a fourth set of ports disposed to provide fluid communication between said gas conduit and said outer annular chamber;

means for controlling the flow of fluid through said fourth set of ports; and a rupture disc disposed in said gas conduit to seal the fluid in said annular chambers and said gas conduit.

2. A variable energy missile eject system as set forth in claim 1, wherein the means for controlling the flow of fluid through said fourth set of ports comprises an arcuate member disposed over the outer portion of said fourth set of ports and means for moving said arcuate member away from said ports.

3. A variable energy missile eject system as set forth in claim 2, wherein the means for moving said arcuate member away from said ports comprises a fluid actuated cylinder.

4. A variable energy missile eject system as set forth in claim 1 and further comprising a spool piece disposed on the lower end of the housing and said spool piece having a centrally located sleeve forming a gas conduit aligned with the gas conduit of said standpipe and an annular chamber, said fourth set of ports being disposed in said sleeve, and conduit means which provide fluid communication between said outer annular chamber in said housing and said annular chamber in said spool piece.

5. A variable energy missile eject system as set forth in claim 4 wherein the means to control the flow of fluid through the four sets of ports comprises a rupture disc disposed in said conduit means.

6. A variable energy missile eject system as set forth in claim 4 wherein the means for controlling the flow of fluid to said fourth set of ports is disposed in said conduit means.

7. A variable energy missile eject system as set forth in claim 6 wherein the means for controlling the flow of fluid to said fourth set of ports is a valve disposed in said conduit means.

* * * * *